US009771659B2

(12) United States Patent
Liu et al.

(10) Patent No.: US 9,771,659 B2
(45) Date of Patent: *Sep. 26, 2017

(54) SYSTEMS AND METHODS OF PROTECTING ELECTROLYSIS CELL SIDEWALLS

(71) Applicant: ALCOA INC., Pittsburgh, PA (US)

(72) Inventors: Xinghua Liu, Murrysville, PA (US); Douglas A. Weirauch, Jr., State College, PA (US); Frankie E. Phelps, Apollo, PA (US); Joseph M. Dynys, New Kensington, PA (US); Jonell Kerkhoff, Murrysville, PA (US); Robert A. DiMilia, Greensburg, PA (US)

(73) Assignee: Alcoa USA Corp., Pittsburgh, PA (US)

( * ) Notice: Subject to any disclaimer, the term of this patent is extended or adjusted under 35 U.S.C. 154(b) by 136 days.

This patent is subject to a terminal disclaimer.

(21) Appl. No.: 14/206,300

(22) Filed: Mar. 12, 2014

(65) Prior Publication Data

US 2014/0262807 A1 Sep. 18, 2014

Related U.S. Application Data

(60) Provisional application No. 61/780,493, filed on Mar. 13, 2013.

(51) Int. Cl.

| | |
|---|---|
| ***C25C 3/08*** | (2006.01) |
| ***C25C 3/14*** | (2006.01) |
| ***C25C 3/20*** | (2006.01) |

(52) U.S. Cl.

CPC ..... *C25C 3/08* (2013.01); *C25C 3/085* (2013.01); *C25C 3/14* (2013.01); *C25C 3/20* (2013.01)

(58) Field of Classification Search

CPC ..... C25C 3/08; C25C 3/20

See application file for complete search history.

(56) References Cited

U.S. PATENT DOCUMENTS 3,852,173 A * 12/1974 Jacobs ..... C25C 3/18 205/392

4,052,288 A * 10/1977 Sala ..... C04B 35/52 204/244

(Continued)

FOREIGN PATENT DOCUMENTS

| | | |
|---|---|---|
| CN | 1434881 | 8/2003 |
| RU | 2336369 C2 | 10/2008 |

(Continued)

OTHER PUBLICATIONS

International Search Report and Written Opinion of the International Searching Authority dated Aug. 6, 2014 from corresponding International Application No. PCT/US2014/024772.

(Continued)

*Primary Examiner* — Harry D Wilkins, III

(74) *Attorney, Agent, or Firm* — Greenberg Traurig, LLP

(57) ABSTRACT

A system is provided including an electrolysis cell configured to retain a molten electrolyte bath, the bath including at least one bath component, the electrolysis cell including: a bottom, and a sidewall consisting essentially of the at least one bath component; and a feeder system, configured to provide a feed material including the least one bath component to the molten electrolyte bath such that the at least one bath component is within 2% of saturation, wherein, via the feed material, the sidewall is stable in the molten electrolyte bath.

32 Claims, 11 Drawing Sheets

(56) References Cited

U.S. PATENT DOCUMENTS

| | | | | |
|---|---|---|---|---|
| 4,224,128 | A * | 9/1980 | Walton | C25C 3/08 204/247.3 |
| 4,877,507 | A | 10/1989 | Hudson et al. | |
| 4,999,097 | A | 3/1991 | Sadoway | |
| 5,006,209 | A * | 4/1991 | Beck | C25C 3/06 204/233 |
| 5,094,728 | A * | 3/1992 | Entner | C25C 3/20 204/245 |
| 5,108,557 | A * | 4/1992 | Nordquist | C25C 3/14 204/245 |
| 5,254,232 | A | 10/1993 | Sadoway | |
| 5,284,562 | A * | 2/1994 | Beck | C25C 3/12 204/244 |
| 5,378,326 | A * | 1/1995 | Kumpulainen | C25C 3/14 204/245 |
| 5,405,506 | A * | 4/1995 | Kumpulainen | C25C 3/14 204/245 |
| 5,476,574 | A * | 12/1995 | Welch | C25C 3/14 204/245 |
| 6,001,236 | A * | 12/1999 | de Nora | C04B 41/009 204/290.02 |
| 6,436,272 | B1 * | 8/2002 | Brown | C25C 3/18 204/243.1 |
| 6,811,676 | B2 | 11/2004 | Bradford et al. | |
| 8,025,785 | B2 | 9/2011 | De Nora | |
| 8,206,560 | B2 | 6/2012 | Feng | |
| 2003/0141197 | A1 | 7/2003 | Barnett et al. | |
| 2003/0196910 | A1 | 10/2003 | Brown | |
| 2003/0196911 | A1 | 10/2003 | Palmer | |
| 2004/0011660 | A1 * | 1/2004 | Bradford | C25C 3/08 205/385 |
| 2008/0017504 | A1 | 1/2008 | Liu et al. | |
| 2009/0236233 | A1 | 9/2009 | D'Astolfo et al. | |
| 2014/0262808 | A1 | 9/2014 | Liu et al. | |
| 2016/0068979 | A1 * | 3/2016 | Liu | C25C 3/20 204/245 |

FOREIGN PATENT DOCUMENTS

| | | |
|---|---|---|
| WO | 2006/053372 A1 | 5/2006 |
| WO | 2007105124 | 9/2007 |
| WO | 2008/014042 | 1/2008 |
| WO | 2012104640 | 8/2012 |

OTHER PUBLICATIONS

International Search Report and Written Opinion of the International Searching Authority dated Jul. 4, 2014 from corresponding International Application No. PCT/US2014/024887.

European Search Report from European Patent Application No. 14779301.2 dated Aug. 30, 2016.

* cited by examiner

SYSTEMS AND METHODS OF PROTECTING ELECTROLYSIS CELL SIDEWALLS

CROSS-REFERENCE TO RELATED APPLICATIONS

This application is a non-provisional of and claims priority to U.S. Application Ser. No. 61/780,493, entitled "Systems and Methods of Protecting Electrolysis Cells" filed on Mar. 13, 2013, which is incorporated by reference in its entirety.

BACKGROUND

Traditionally, sidewalls of an electrolysis cell are constructed of thermally conductive materials to form a frozen ledge along the entire sidewall (and upper surface of the bath) to maintain cell integrity.

FIELD OF THE INVENTION

Broadly, the present disclosure relates to sidewall features (e.g. inner sidewall or hot face) of an electrolysis cell, which protect the sidewall from the electrolytic bath while the cell is in operation (e.g. producing metal in the electrolytic cell). More specifically, the inner sidewall features provide for direct contact with the metal, bath, and/or vapor in an electrolytic cell in the absence of the frozen ledge along the entire or a portion of inner sidewall.

SUMMARY OF THE DISCLOSURE

Through the various embodiments of the instant disclosure, the sidewall of the electrolysis cell is replaced, at least in part, by one or more sidewall embodiments of the instant disclosure.

In some embodiments, a stable sidewall material is provided, which is stable (e.g. substantially non-reactive) in the molten electrolyte (e.g. the cell bath) by maintaining one or more components in the bath chemistry at a certain percentage of saturation. In some embodiments, the bath chemistry is maintained via at least one feeding device located along the sidewall, which provides a feed material into the cell (e.g. which is retained as a protecting deposit located adjacent to the sidewall of the cell). In some embodiments, the protecting depict supplies at least one bath component (e.g. alumina) to the bath (e.g. to the bath immediately adjacent to the sidewall). As a non-limiting example, as the protecting deposit is slowly dissolved, the bath chemistry adjacent to the sidewall is at or near saturation for that bath component, thus protecting the sidewall from dissolving (e.g. solubilizing/corroding) by interacting with the molten electrolyte/bath. In some embodiments, the percent saturation of the bath for a particular bath component (e.g. alumina) is a function of the feed material concentration (e.g. alumina) at cell operating conditions (e.g. temperature, bath ratio, and bath and/or content).

In some embodiments, the sidewalls of the instant disclosure provide for an energy savings of: at least about 5%; at least about 10%; at least about 15%; at least about 20%; at least about 25%; or at least about 30% over the traditional thermally conductive material package.

In some embodiments, the heat flux (i.e. heat lost through the sidewall of the cell during cell operation) is: not greater than about 5 kW/m$^2$; not greater than about 4 kW/m$^2$; not greater than about 3 kW/m$^2$; not greater than about 2 kW/m$^2$; not greater than about 1 kW/m$^2$; not greater than about 0.75 kW/m$^2$.

In some embodiments, the heat flux (i.e. heat lost through the sidewall of the cell during cell operation) is: at least about 5 kW/m$^2$; at least about 4 kW/m$^2$; at least about 3 kW/m$^2$; at least about 2 kW/m$^2$; at least about 1 kW/m$^2$; at least about 0.75 kW/m$^2$.

In stark contrast, commercial hall cells operate with a heat flux through the sidewall of between about 8-12 kW/m$^2$.

In one aspect of the instant disclosure, a system is provided, comprising: an electrolysis cell configured to retain a molten electrolyte bath, the bath including at least one bath component, the electrolysis cell including: a bottom (e.g. cathode or metal pad) and a sidewall consisting essentially of the at least one bath component; and a feeder system, configured to provide a feed material including the least one bath component to the molten electrolyte bath such that the at least one bath component is within about 2% of saturation, wherein, via the feed material, the sidewall is stable in the molten electrolyte bath.

In some embodiments, the bath comprises a feed material (e.g. alumina) at a content above its saturation limit (e.g. such that there is particulate present in the bath).

In some embodiments, the bath component (e.g. alumina) comprises an average bath content of: within about 2% of saturation; within about 1.5% of saturation; within about 1% of saturation; within about 0.5% of saturation; at saturation; or above saturation (e.g. undissolved particulate of the bath component is present in the bath).

In some embodiments, the saturation of the bath component is: at least about 95% of saturation; at least about 96% of saturation; at least about 97% of saturation; at least about 98% of saturation; at least about 99% of saturation; at 100% of saturation; or above saturation (e.g. undissolved particulate of the bath component is present in the bath).

In some embodiments, the saturation of the bath component is: not greater than about 95% of saturation; not greater than about 96% of saturation; not greater than about 97% of saturation; not greater than about 98% of saturation; not greater than about 99% of saturation; or not greater than 100% of saturation.

In some embodiments, the bath component comprises a bath content saturation percentage measured as an average throughout the cell. In some embodiments, the bath component comprises a bath content saturation percentage measured at a location adjacent to the sidewall (e.g. non-reactive/stable sidewall material).

In some embodiments, the location adjacent to the sidewall is the bath: touching the wall; not greater than about 1" from the wall; not greater than about 2" from the wall, not greater than about 4" from the wall; not greater than about 6" from the wall; not greater than about 8" from the wall; not greater than about 10" from the wall; not greater than about 12" from the wall; not greater than about 14" from the wall; not greater than about 16" from the wall; not greater than about 18" from the wall; not greater than about 20" from the wall; not greater than about 22" from the wall, or not greater than about 24" from the wall.

In some embodiments, the location adjacent to the sidewall is the bath: touching the wall; less than about 1" from the wall; less than about 2" from the wall, less than about 4" from the wall; less than about 6" from the wall; less than about 8" from the wall; less than about 10" from the wall; less than about 12" from the wall; less than about 14" from the wall; less than about 16" from the wall; less than about 18" from the wall; less than about 20" from the wall; less than about 22" from the wall, or less than about 24" from the wall.

In one aspect of the instant disclosure, a system is provided, comprising: an electrolysis cell body configured to retain a molten electrolyte bath, the bath including alumina, the electrolysis cell including: a bottom (e.g. cathode or metal pad) and a sidewall consisting essentially of alumina; and a feeder system, configured to provide a feed material including alumina to the molten electrolyte bath such that a bath content of alumina is within about 10% of saturation, wherein, via the bath content, the sidewall is stable in the molten electrolyte bath.

In one aspect of the instant disclosure, an electrolysis cell is provided, comprising: an anode; a cathode in spaced relation from the anode; an electrolyte bath in liquid communication with the anode and cathode, the bath having a bath chemistry comprising a plurality of bath components; a cell body comprising: a bottom and at least one sidewall surrounding the bottom, wherein the sidewall consists essentially of: at least one bath component in the bath chemistry, wherein the bath chemistry comprises the at least one bath component within about 10% of the saturation limit for that component, such that, via the bath chemistry, the sidewall is maintained at the sidewall-to-bath interface (e.g. during cell operation).

In one aspect of the instant disclosure, an electrolysis cell is provided, comprising: an anode; a cathode in spaced relation from the anode; a molten electrolyte bath in liquid communication with the anode having a bath chemistry; a cell body comprising a bottom and at least one sidewall surrounding the bottom, wherein the cell body is configured to contact and retain the molten electrolyte bath, further wherein the sidewall is constructed of a material which is a component of the bath chemistry; and a feed device configured to provide a feed including the component into the molten electrolyte bath; wherein, via the feed device, the bath chemistry is maintained at or near saturation of the component such that the sidewall remains stable in the molten salt electrolyte.

In one aspect of the instant disclosure, an electrolysis cell is provided, comprising: an anode; a cathode in spaced relation from the anode; a molten electrolyte bath in liquid communication with the anode and the cathode, wherein the molten electrolyte bath comprises a bath chemistry including at least one bath component; a cell body having: a bottom and at least one sidewall surrounding the bottom, wherein the cell body is configured to retain the molten electrolyte bath, wherein the sidewall consists essentially of the at least one bath component, the sidewall further comprising: a first sidewall portion, configured to fit onto a thermal insulation package of the sidewall and retain the electrolyte; and a second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough; wherein the trough is configured to receive a protecting deposit and retain the protecting deposit separately from the cell bottom (e.g. metal pad); wherein the protecting deposit is configured to dissolve from the trough into the molten electrolyte bath such that the molten electrolyte bath comprises a level of the at least one bath component which is sufficient to maintain the first sidewall portion and second sidewall portion in the molten electrolyte bath.

In one aspect of the instant disclosure, an electrolysis cell is provided, comprising: an anode; a cathode in spaced relation from the anode; a molten electrolyte bath in liquid communication with the anode and the cathode, wherein the molten electrolyte bath comprises a bath chemistry including at least one bath component; a cell body having: a bottom and at least one sidewall surrounding the bottom, wherein the cell body is configured to retain the molten electrolyte bath, wherein the sidewall consists essentially of the at least one bath component, the sidewall further comprising: a first sidewall portion, configured to fit onto a thermal insulation package of the sidewall and retain the electrolyte; and a second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough; wherein the trough is configured to receive a protecting deposit and retain the protecting deposit separate from the cell bottom (e.g. metal pad); wherein the protecting deposit is configured to dissolve from the trough into the molten electrolyte bath such that the molten electrolyte bath comprises a level of the at least one bath component which is sufficient to maintain the first sidewall portion and second sidewall portion in the molten electrolyte bath; and a directing member, wherein the directing member is positioned between the first sidewall portion and the second sidewall portion, further wherein the directing member is laterally spaced above the trough, such that the directing member is configured to direct the protecting deposit into the trough.

In some embodiments, the sidewall comprises a first portion and a second portion, wherein the second portion is configured to align with the first sidewall portion with respect to the thermal insulation package, further wherein the second sidewall portion is configured to extend from the sidewall (e.g. sidewall profile) in a stepped configuration, wherein the second sidewall portion comprises a top/upper surface and a side surface which define the stepped portion. In some embodiments, the top surface is configured to provide a planar surface (e.g. flat, or parallel with the cell bottom). In some embodiments, the top surface is configured to provide a sloped/angled surface, which is sloped towards the first sidewall portion such that the first sidewall portion and the upper surface of the second sidewall portion cooperate to define a recessed area. In some embodiments, the sloped stable sidewall is sloped towards the center of the cell/metal pad (away from the sidewall). In some embodiments, the cell comprises a feeder configured to provide a feed to the cell, which is retained along at least a portion of the planar top surface and/or side of the second sidewall portion as a protecting deposit. In some embodiments, the cell comprises a feeder configured to provide a feed into the cell, which is retained along the recessed area (e.g. upper surface of the second sidewall portion.)

In some embodiments, the base comprises the at least one bath component.

In some embodiments, the protecting deposit comprises one bath component (at least one). In some embodiments, the protecting deposit comprises at least two bath components.

In some embodiments, the protecting deposit extends from the trough and up to at least an upper surface of the electrolyte bath.

In some embodiments, the cell further comprises a directing member, wherein the directing member is positioned between the first sidewall portion and the second sidewall portion, further wherein the directing member is positioned above the base of the trough, further wherein the directing member is configured to direct the protecting deposit into the trough. In some embodiments, the directing member is composed of a stable material (e.g. non-reactive material in the bath and/or vapor phase).

In some embodiments, the directing member is constructed of a material which is present in the bath chemistry, such that via the bath chemistry, the directing member is maintained in the molten salt electrolyte.

In some embodiments, the base of the trough is defined by a feed block, wherein the feed block is constructed of a material selected from components in the bath chemistry, wherein via the bath chemistry, the feed block is maintained in the molten salt bath. In some embodiments, the feed block comprises a stable material (non-reactive material). In some embodiments, the feed block comprises alumina.

In some embodiments, the cell further comprises a feeder (e.g. feed device) configured to provide the protecting deposit in the trough.

In some embodiments, the feed device is attached to the cell body.

In one aspect of the instant disclosure, a method is provided, comprising: passing current between an anode and a cathode through a molten electrolyte bath of an electrolytic cell, feeding a feed material into the electrolytic cell to supply the molten electrolyte bath with at least one bath component, wherein feeding is at a rate sufficient to maintain a bath content of the at least one bath component to within about 95% of saturation; and via the feeding step, maintaining a sidewall of the electrolytic cell constructed of a material including the at least one bath component.

In some embodiments, the method includes: concomitant to the first step, maintaining the bath at a temperature not exceeding 960° C., wherein the sidewalls of the cells are substantially free of a frozen ledge.

In some embodiments, the method includes consuming the protecting deposit to supply metal ions to the electrolyte bath.

In some embodiments, the method includes producing a metal product from the at least one bath component.

Various ones of the inventive aspects noted hereinabove may be combined to yield apparatuses, assemblies, and methods related to primary metal production in electrolytic cells at low temperature (e.g. below 960° C.).

These and other aspects, advantages, and novel features of the invention are set forth in part in the description that follows and will become apparent to those skilled in the art upon examination of the following description and figures, or may be learned by practicing the invention.

BRIEF DESCRIPTION OF THE DRAWINGS

FIG. 11A depicts a transverse configuration, angled towards the center of the cell (to promote cell drain). FIG. 11B depicts a transverse configuration, angled towards the sidewall (to promote retention of the feed material in the protecting deposit). FIG. 11C depicts an angled configuration (e.g. pointed). FIG. 11D depicts a curved, or arcuate upper most region of the shelf or second sidewall portion.

DETAILED DESCRIPTION

Figure 1:
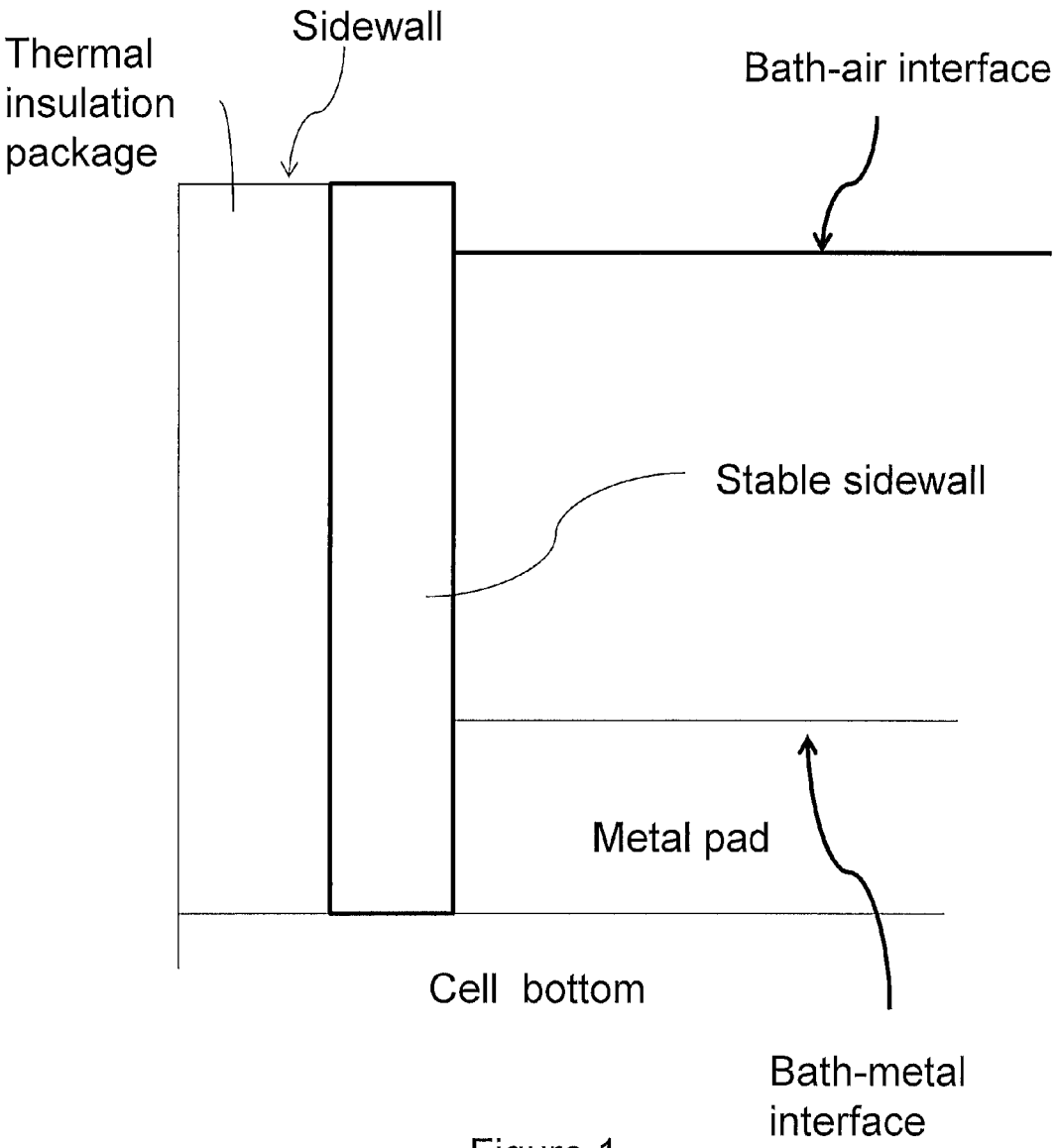
FIG. 1 depicts a schematic side view of an electrolysis cell in operation, the cell having a stable sidewall (e.g. non-reactive material), in accordance with the instant disclosure.
Figure 2:
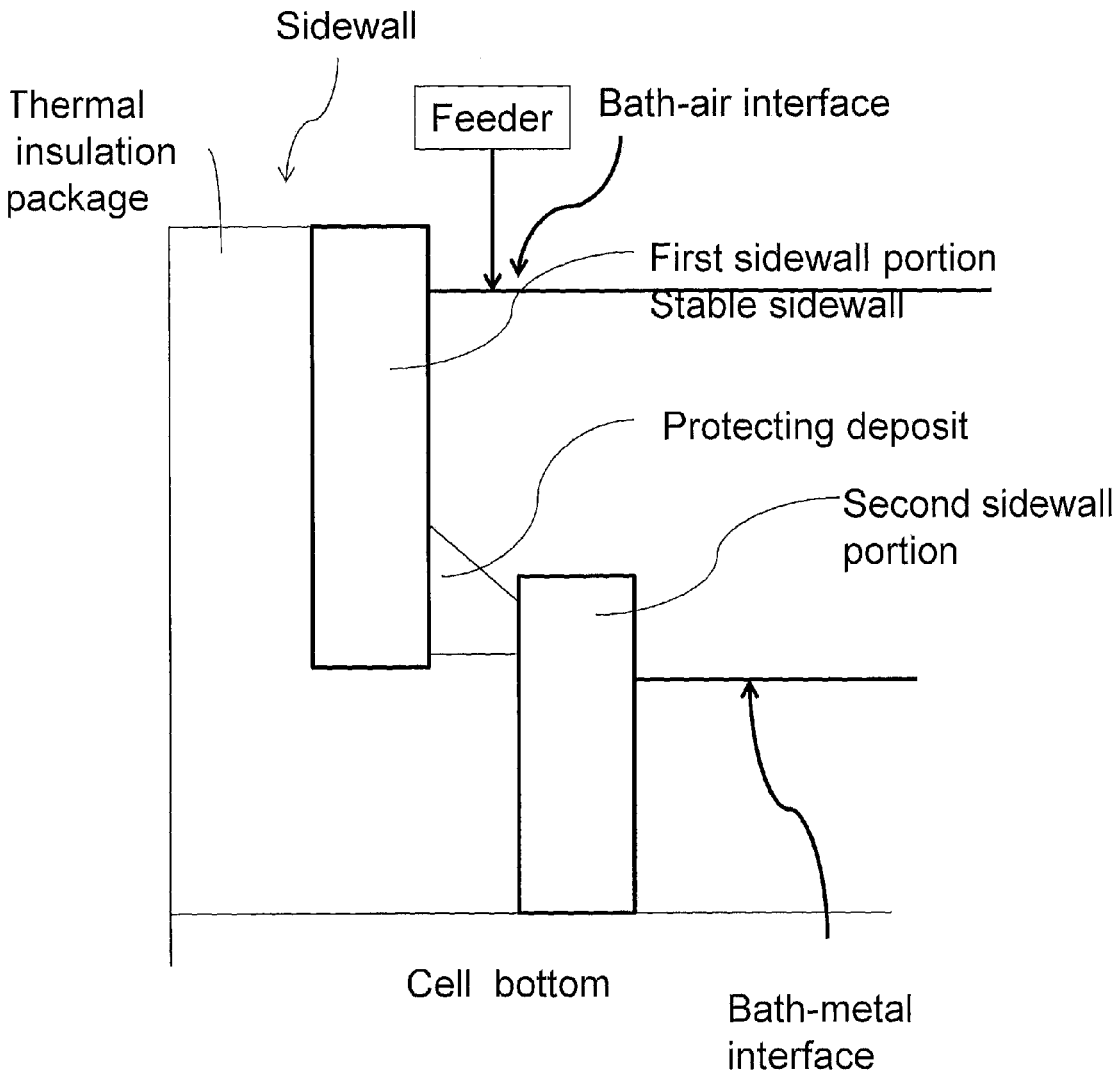
FIG. 2 depicts a schematic side view of an electrolysis cell in operation, the cell having a first sidewall portion and a second sidewall portion with a feeder providing a protecting deposit between the sidewall portions, in accordance with the instant disclosure.
Figure 3:
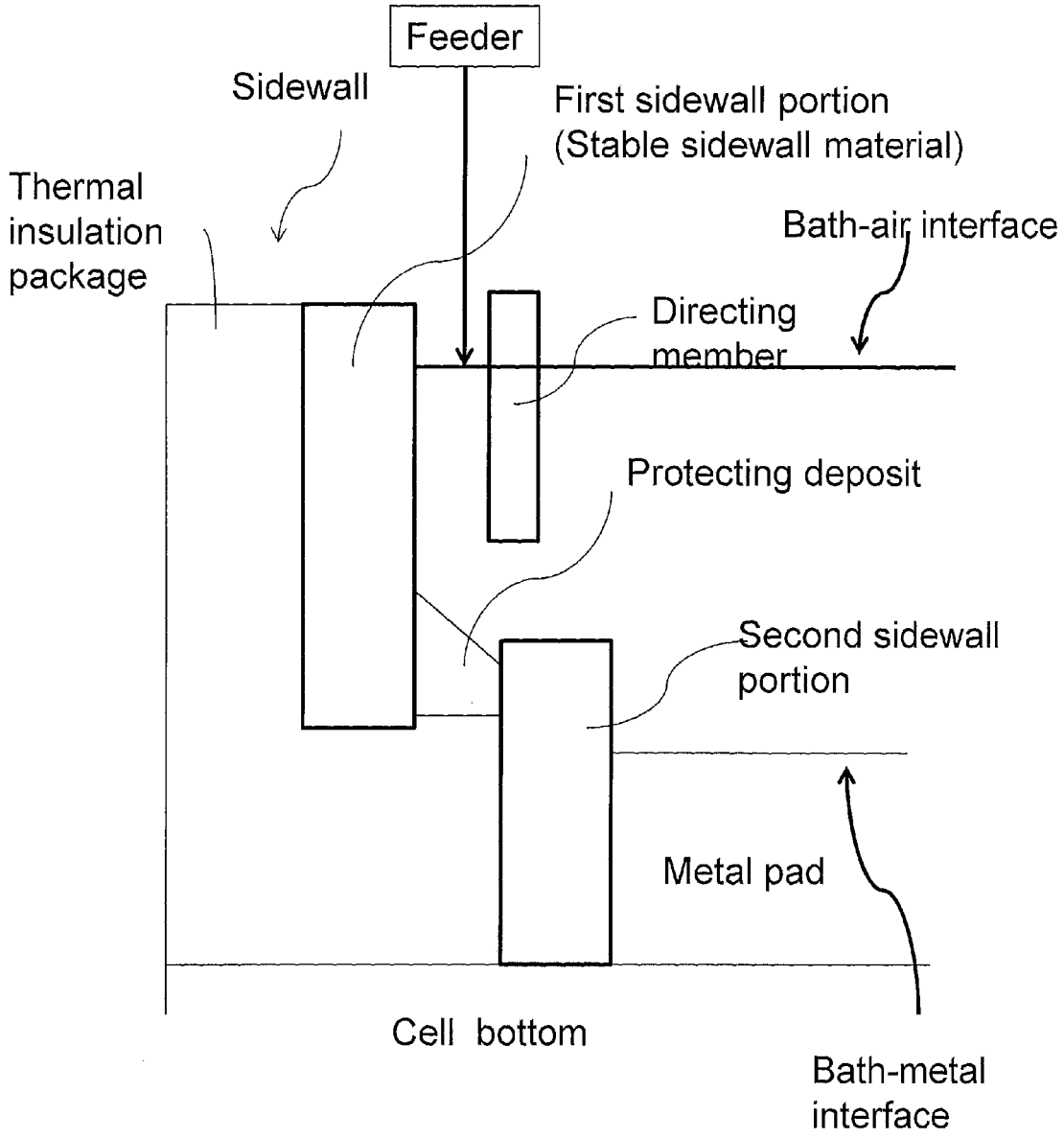
FIG. 3 depicts a schematic side view of an electrolysis cell in operation, the cell having a first sidewall portion and a second sidewall portion with a feeder providing a protecting deposit between the sidewall portions and including a directing member, in accordance with the instant disclosure.
Figure 4:
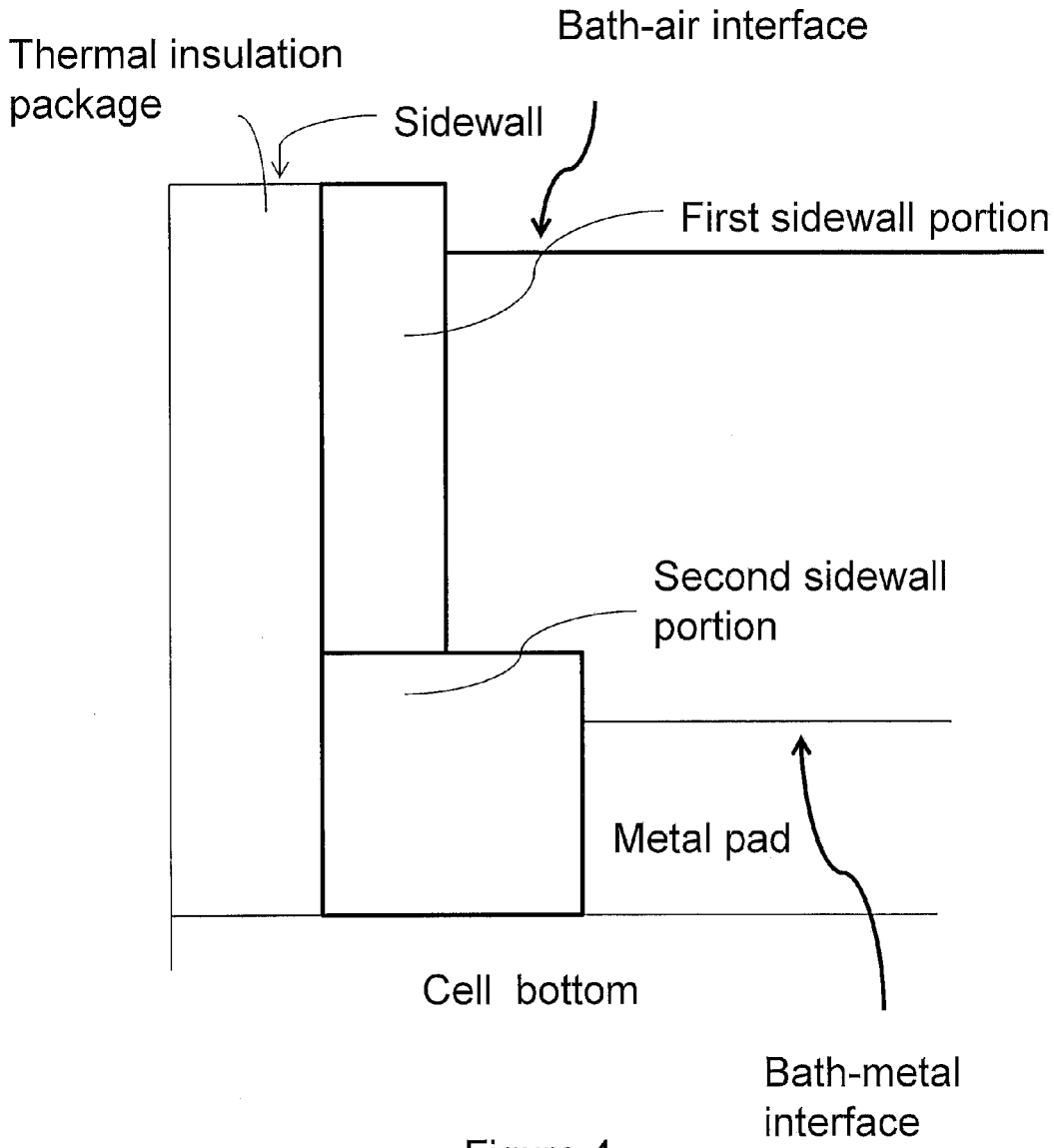
FIG. 4 depicts a schematic side view of an electrolysis cell in operation, the cell having a sidewall which has two stable sidewall portions, the first sidewall portion and second sidewall portion configured to attach to the thermal insulation package, wherein the second sidewall portion extends beyond first sidewall portion (e.g. is configured to provide a stepped/extended configuration), in accordance with the instant disclosure.
Figure 5:
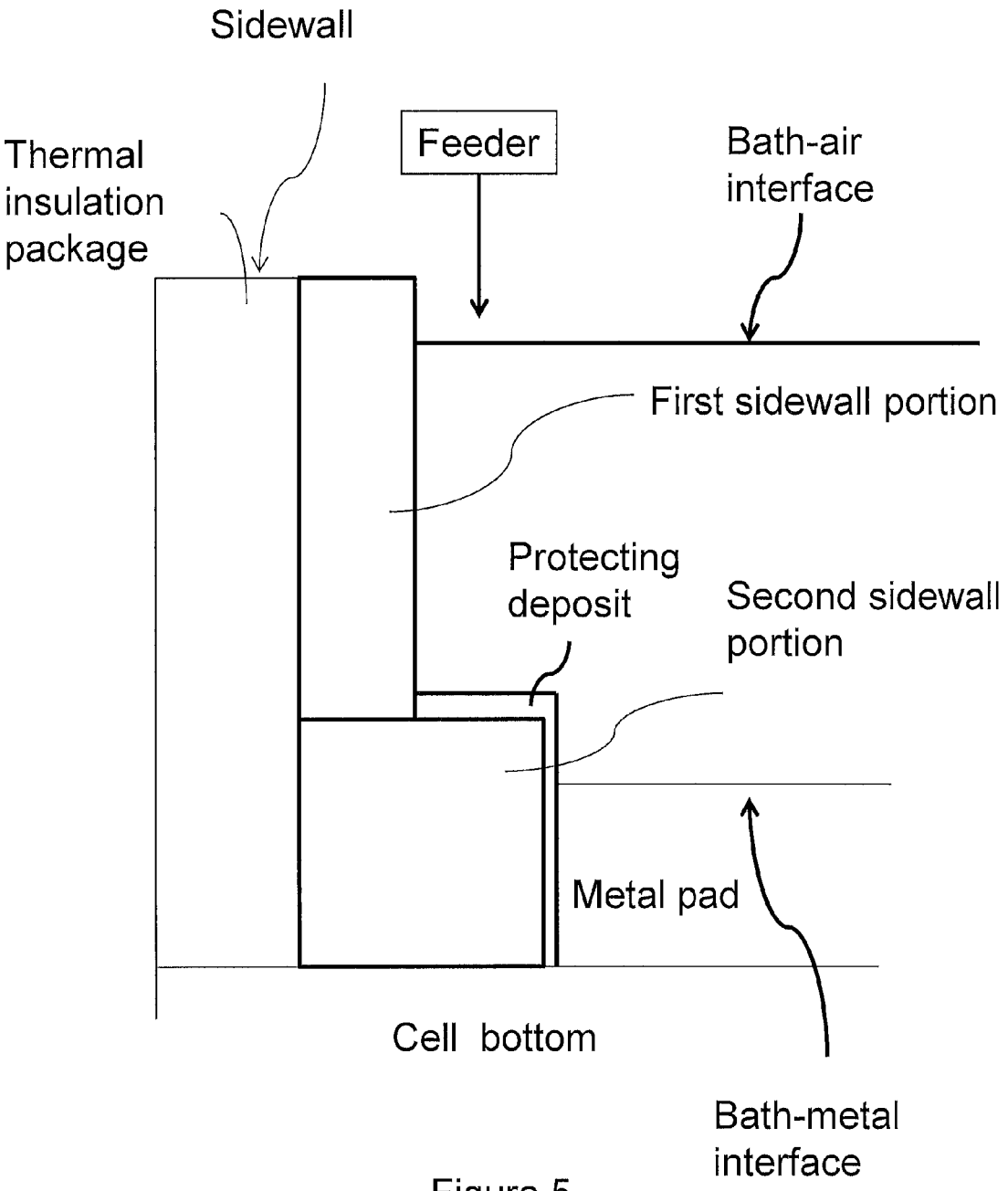
FIG. 5 depicts a schematic side view of an electrolysis cell in operation, the cell having a sidewall which has two stable sidewall portions, the first sidewall portion and second sidewall portion configured to attach to the thermal insulation package, wherein the second sidewall portion extends beyond first sidewall portion (e.g. is configured to provide a stepped/extended configuration), including a protecting deposit provided by a feeder, in accordance with the instant disclosure.
Figure 6:
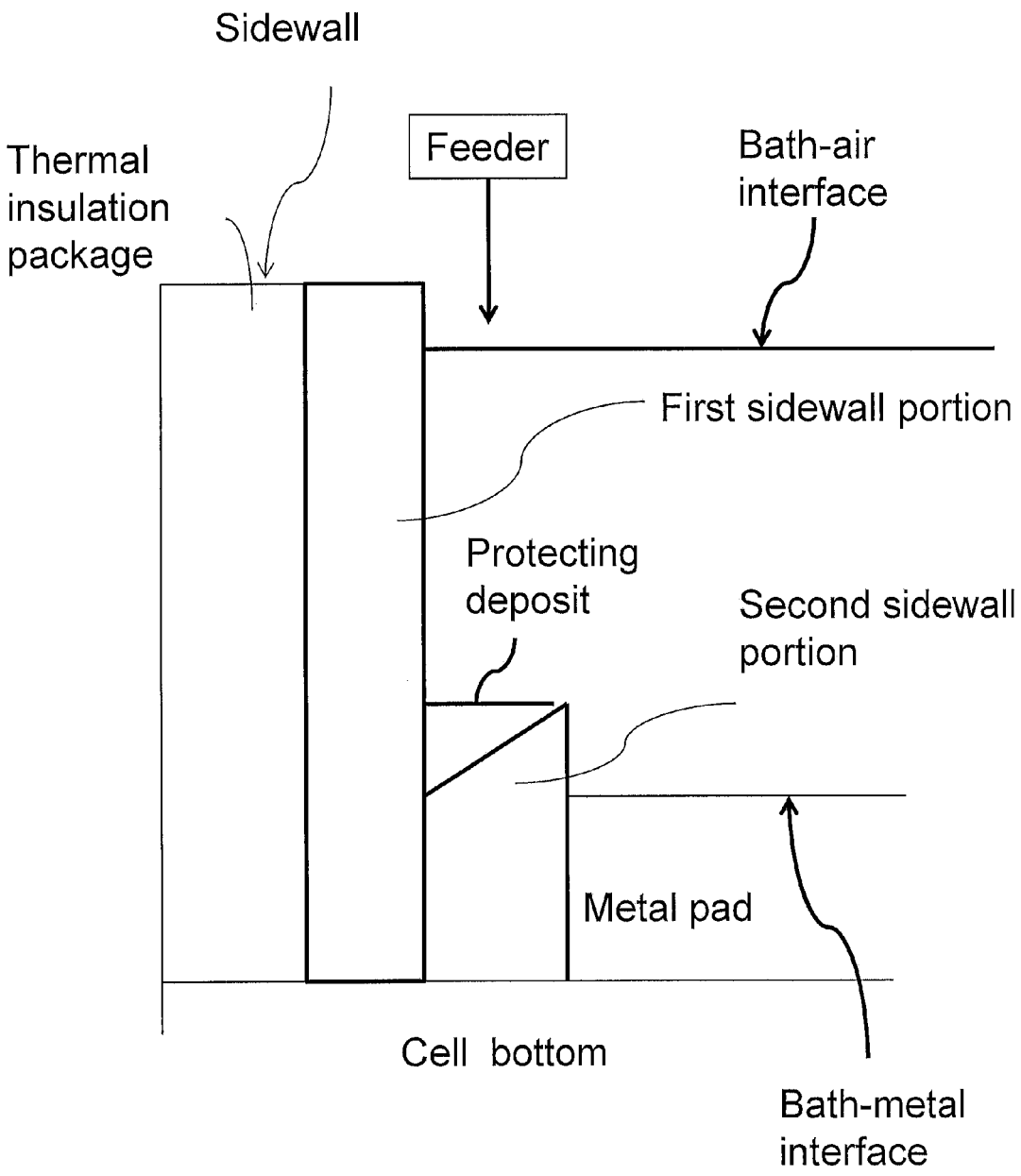
FIG. 6 depicts a schematic side view of another embodiment of an electrolysis cell in operation, the cell having a sidewall which has two stable sidewall portions, the first sidewall portion and second sidewall portion configured to attach to the thermal insulation package, wherein the second sidewall portion extends beyond first sidewall portion (e.g. is configured to provide a stepped/extended configuration), including a protecting deposit provided by a feeder, in accordance with the instant disclosure.
Figure 7:
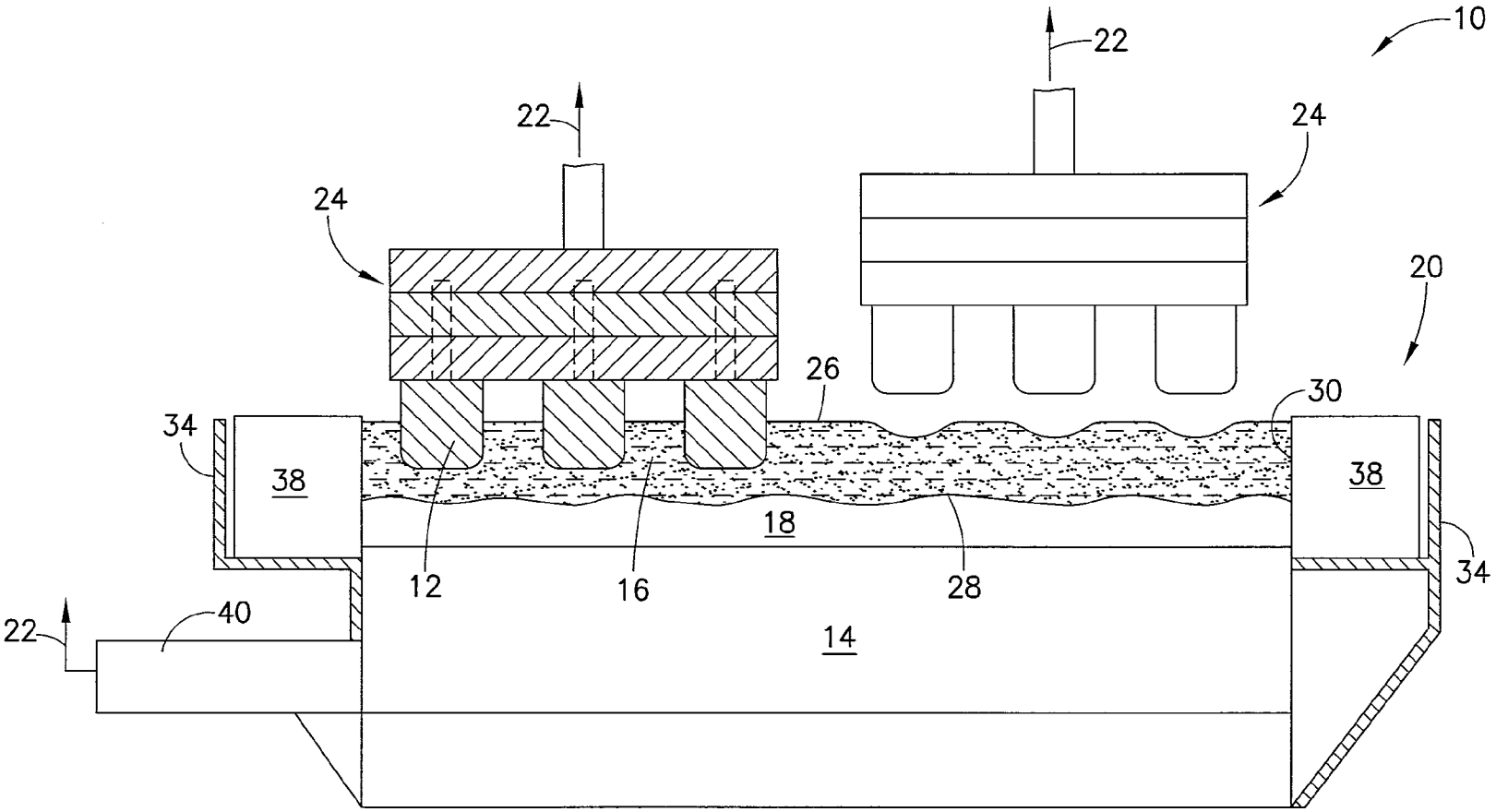
FIG. 7 depicts a schematic side view of an electrolysis cell in operation, in accordance with the instant disclosure (e.g. active sidewall is one or more of the embodiments of the instant disclosure).
Figure 8:
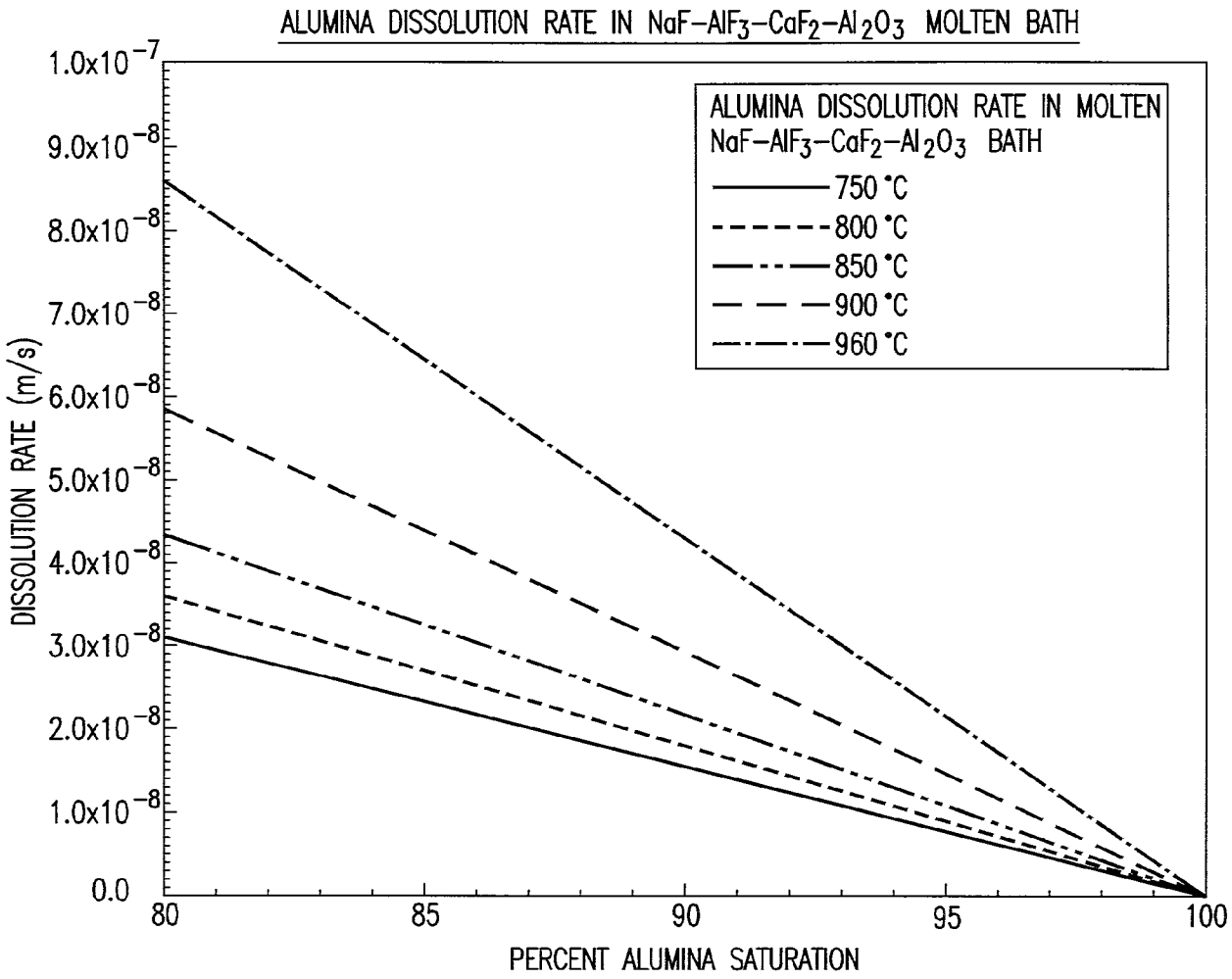
FIG. 8 is a chart depicting the alumina dissolution rate (m/s) in electrolytic bath per percent alumina saturation, plotted at five (5) different temperature lines (750° C., 800° C., 850° C., 900° C., and 950° C.).
Figure 9:
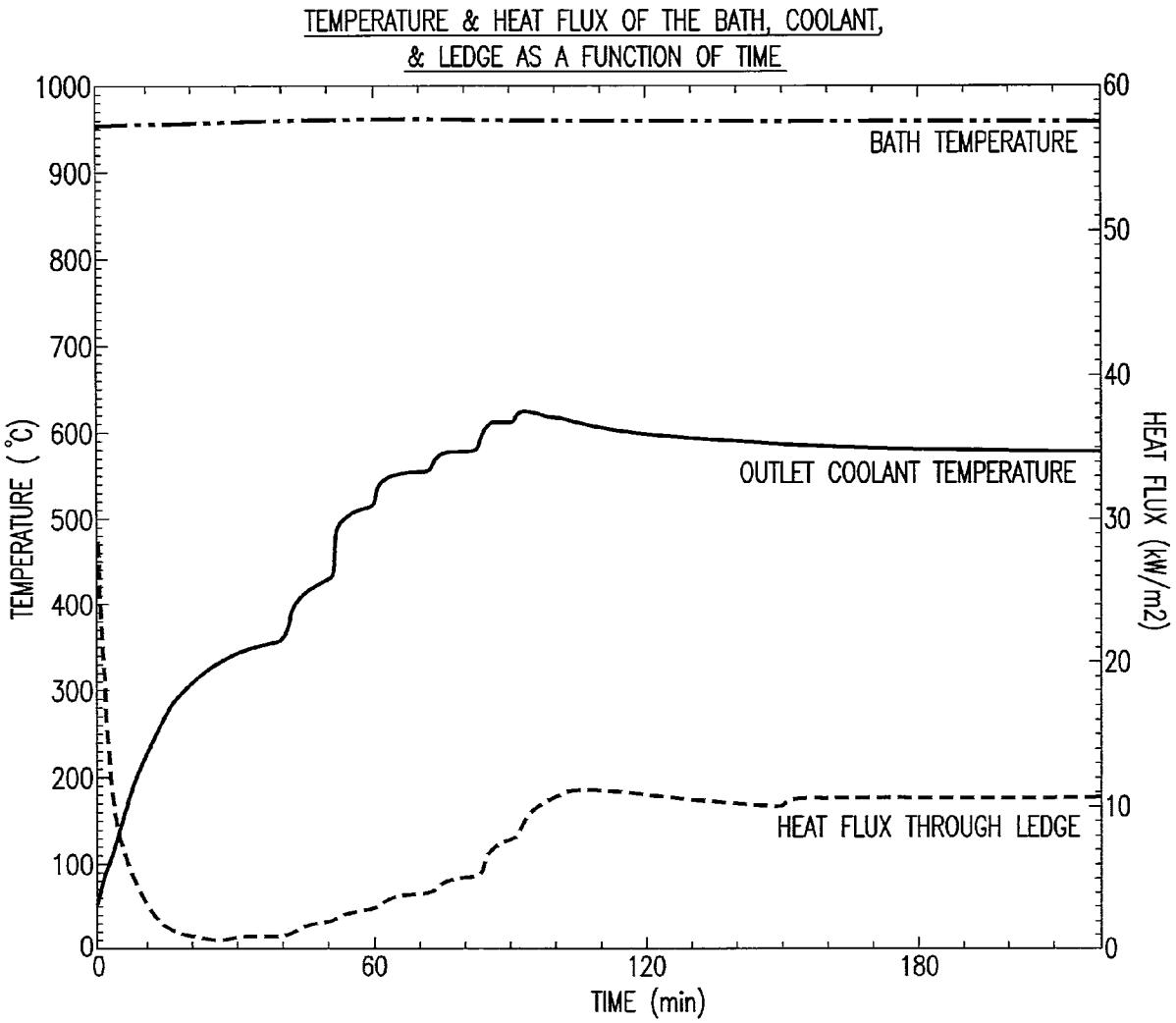
FIG. 9 is a chart of temperature and heat flux of the bath, coolant, and outlet ledge as a function of time.
Figure 10A:
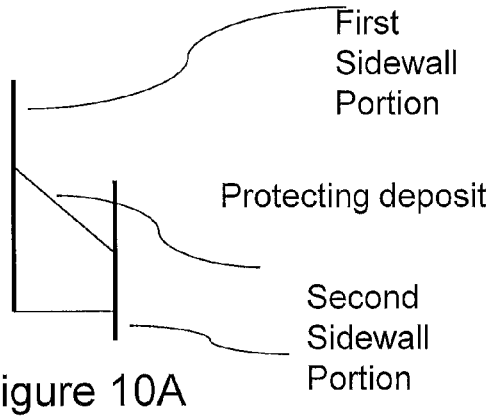
FIG. 10A-H depict a partial cut away side view of various angles of the protecting deposit and the trough bottom/base (sometimes called a feed block) beneath the protecting deposit. Various angles of the protecting deposit are depicted (angling towards the second sidewall portion, angled towards the first sidewall portion, flat, angled, and the like). Also, various angles of the trough bottom/base are depicted (angling towards the second sidewall portion, angled towards the first sidewall portion, flat, angled, and the like).
Figure 10B:
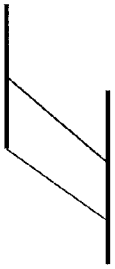
Figure 10C:
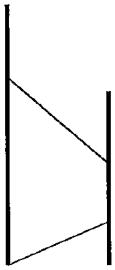
Figure 10D:
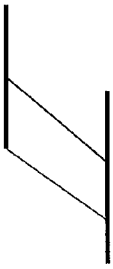
Figure 10E:
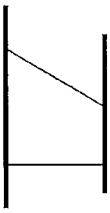
Figure 10F:
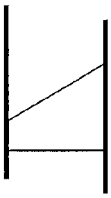
Figure 10G:
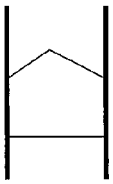
Figure 10H:
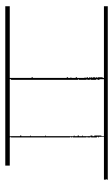
Figure 11A:
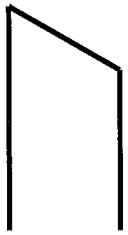
FIG. 11A-D depict a partial cut-away side view of the various configurations of the shelf top and/or second sidewall portion.
Figure 11B:
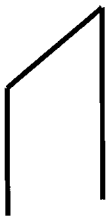
Figure 11C:
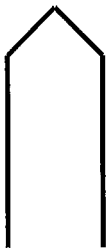
Figure 11D:
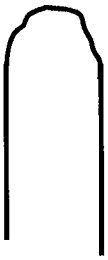

Reference will now be made in detail to the accompanying drawings, which at least assist in illustrating various pertinent embodiments of the present invention.

As used herein, "electrolysis" means any process that brings about a chemical reaction by passing electric current through a material. In some embodiments, electrolysis occurs where a species of metal is reduced in an electrolysis cell to produce a metal product. Some non-limiting examples of electrolysis include primary metal production. Some non-limiting examples of electrolytically produced metals include: rare earth metals, non-ferrous metals (e.g. copper, nickel, zinc, magnesium, lead, titanium, aluminum, and rare earth metals). As used herein, "electrolysis cell" means a device for producing electrolysis. In some embodiments, the electrolysis cell includes a smelting pot, or a line of smelters (e.g. multiple pots). In one non-limiting example, the electrolysis cell is fitted with electrodes, which act as a conductor, through which a current enters or leaves a nonmetallic medium (e.g. electrolyte bath).

As used herein, "electrode" means positively charged electrodes (e.g. anodes) or negatively charged electrodes (e.g. cathodes).

As used herein, "anode" means the positive electrode (or terminal) by which current enters an electrolytic cell. In some embodiments, the anodes are constructed of electrically conductive materials. Some non-limiting examples of anode materials include: metals, metal alloys, oxides, ceramics, cermets, carbon, and combinations thereof.

As used herein, "anode assembly" includes one or more anode(s) connected with, a support. In some embodiments, the anode assembly includes: the anodes, the support (e.g. refractory block and other bath resistant materials), and the electrical bus work.

As used herein, "support" means a member that maintains another object(s) in place. In some embodiments, the support is the structure that retains the anode(s) in place. In one embodiment, the support facilitates the electrical connection of the electrical bus work to the anode(s). In one embodiment, the support is constructed of a material that is resistant to attack from the corrosive bath. For example, the support is constructed of insulating material, including, for example refractory material. In some embodiments, multiple anodes are connected (e.g. mechanically and electrically) to the support (e.g. removably attached), which is adjustable and can be raised, lowered, or otherwise moved in the cell.

As used herein, "electrical bus work" refers to the electrical connectors of one or more component. For example, the anode, cathode, and/or other cell components can have electrical bus work to connect the components together. In some embodiments, the electrical bus work includes pin connectors in the anodes, the wiring to connect the anodes and/or cathodes, electrical circuits for (or between) various cell components, and combinations thereof.

As used herein, "cathode" means the negative electrode or terminal by which current leaves an electrolytic cell. In some embodiments, the cathodes are constructed of an electrically conductive material. Some non-limiting examples of the cathode material include: carbon, cermet, ceramic material(s), metallic material(s), and combinations thereof. In one embodiment, the cathode is constructed of a transition metal boride compound, for example TiB2. In some embodiments, the cathode is electrically connected through the bottom of the cell (e.g. current collector bar and electrical buswork). As some non-limiting examples, cathodes are constructed of: TiB2, TiB2-C composite materials, boron nitride, zirconium borides, hafnium borides, graphite, and combinations thereof.

As used herein, "cathode assembly" refers to the cathode (e.g. cathode block), the current collector bar, the electrical bus work, and combinations thereof.

As used herein "current collector bar" refers to a bar that collects current from the cell. In one non-limiting example, the current collector bar collects current from the cathode and transfers the current to the electrical buswork to remove the current from the system.

As used herein, "electrolyte bath" refers to a liquefied bath having at least one species of metal to be reduced (e.g. via an electrolysis process). A non-limiting example of the electrolytic bath composition includes: NaF—AlF3 (in an aluminum electrolysis cell), NaF, AlF3, CF2, MgF2, LiF, KF, and combinations thereof—with dissolved alumina.

As used herein, "molten" means in a flowable form (e.g. liquid) through the application of heat. As a non-limiting example, the electrolytic bath is in molten form (e.g. at least about 750° C.). As another example, the metal product that forms at the bottom of the cell (e.g. sometimes called a "metal pad") is in molten form.

In some embodiments, the molten electrolyte bath/cell operating temperature is: at least about 750° C.; at least about 800° C.; at least about 850° C.; at least about 900° C.; at least about 950° C.; or at least about 975° C. In some embodiments, the molten electrolyte bath/cell operating temperature is: not greater than about 750° C.; not greater than about 800° C.; not greater than about 850° C.; not greater than about 900° C.; not greater than about 950° C.; or not greater than about 975° C.

As used herein, "metal product" means the product which is produced by electrolysis. In one embodiment, the metal product forms at the bottom of an electrolysis cell as a metal pad. Some non-limiting examples of metal products include: aluminum, nickel, magnesium, copper, zinc, and rare earth metals.

As used herein, "sidewall" means the wall of an electrolysis cell. In some embodiments, the sidewall runs parametrically around the cell bottom and extends upward from the cell bottom to defines the body of the electrolysis cell and define the volume where the electrolyte bath is held. In some embodiments, the sidewall includes: an outer shell, a thermal insulation package, and an inner wall. In some embodiments, the inner wall and cell bottom are configured to contact and retain the molten electrolyte bath, the feed material which is provided to the bath (i.e. to drive electrolysis) and the metal product (e.g. metal pad). In some embodiments, the sidewall (inner sidewall) includes a non-reactive sidewall portion (e.g. stable sidewall portion).

As used herein, "transverse" means an angle between two surfaces. In some embodiments, the surfaces make an acute or an obtuse angle. In some embodiments, transverse includes an angle at or that is equal to the perpendicular angle or almost no angle, i.e. surfaces appearing as continuous (e.g. 180°). In some embodiments, a portion of the sidewall (inner wall) is transverse, or angled towards the cell bottom. In some embodiments, the entire sidewall is transverse to the cell bottom. In some embodiments, the stable sidewall material has a sloped top portion (i.e. sloped towards the metal pad/canter of the cell (to assist in draining metal product to the bottom of the cell).

In some embodiments, the entire wall is transverse. In some embodiments, a portion of the wall (first sidewall portion, second sidewall portion, shelf, trough, directing member) is transverse (or, sloped, angled, curved, arcuate).

In some embodiments, the shelf is transverse. In some embodiments, the second sidewall portion is transverse. Without being bound by any particular theory or mechanism, it is believed that by configuring the sidewall (first sidewall portion, second sidewall portion, trough, or shelf) in a transverse manner, it is possible to promote certain characteristics of the cell in operation (e.g. metal drain, feed material direction into the cell/towards the cell bottom). As a non-limiting example, by providing a transverse sidewall, the sidewall is configured to promote feed material capture into a protecting deposit in a trough or shelf (e.g. angled towards/or is configured to promote metal drain into the bottom of the cell).

In some embodiments, the first sidewall portion is transverse (angled/sloped) and the second sidewall portion is not sloped. In some embodiments, the first sidewall portion is not sloped and the second sidewall portion is sloped. In some embodiments, both the first sidewall portion and the second sidewall portion are transverse (angled/sloped).

In some embodiments, the base (or feed block) is transverse (sloped or angled). In some embodiments, the upper portion of the shelf/trough or second sidewall portion is sloped, angled, flat, transverse, or curved.

As used herein, "wall angle", means the angle of the inner sidewall relative to the cell bottom measurable in degrees. For example, a wall angle of 0 degrees refers to a vertical angle (or no angle). In some embodiments, the wall angle comprises: an angle (theta) from 0 degrees to about 30 degrees. In some embodiments, the wall angle comprises an angle (theta) from 0 degrees to 60 degrees. In some embodiments, the wall angle comprises an angle (theta) from about 0 to about 85 degrees.

In some embodiments, the wall angle (theta) is: at least about 5°; at least about 10°; at least about 15°; at least about 20°; at least about 25°; at least about 30°; at least about 35°; at least about 40'; at least about 45°; at least about 50°; at least about 55°; or at least about 60°. In some embodiments, the wall angle (theta) is: not greater than about 5°; not greater than about 10°; not greater than about 15'; not greater than about 20°; not greater than about 25°; not greater than about 30°; not greater than about 35°; not greater than about 40°; not greater than about 45°; not greater than about 50°; not greater than about 55°; or not greater than about 60°.

As used herein, "outer shell" means an outer-most protecting cover portion of the sidewall. In one embodiment, the outer shell is the protecting cover of the inner wall of the electrolysis cell. As non-limiting examples, the outer shell is constructed of a hard material that encloses the cell (e.g. steel).

As used herein, "first sidewall portion" means a portion of the inner sidewall.

As used herein, "second sidewall portion" means another portion of the inner sidewall. In some embodiments, the second portion is a distance (e.g. longitudinally spaced) from the first portion. As one non-limiting example, the second sidewall portion is an upright member having a length and a width, wherein the second portion is spaced apart from the first portion.

In some embodiments, the second portion cooperates with the first portion to retain a material or object (e.g. protecting deposit).

In some embodiments, the second portion is of a continuous height, while in other embodiments, the second portion's height varies. In one embodiment, the second portion is constructed of a material that is resistant to the corrosive environment of the bath and resistant to the metal product (e.g. metal pad), and thus, does not break down or otherwise react in the bath. As some non-limiting examples, the wall is constructed of: $TiB_2$, TiB2-C, SiC, Si3N4, BN, a bath component that is at or near saturation in the bath chemistry (e.g. alumina), and combinations thereof.

In some embodiments, the second portion is cast, hot pressed, or sintered into the desired dimension, theoretical density, porosity, and the like. In some embodiments, the second portion is secured to one or more cell components in order to keep the second portion in place.

As used herein, "directing member" means a member which is configured to direct an object or material in a particular manner. In some embodiments, the directing member is adapted and configured to direct a feed material into a trough (e.g. to be retained in the trough as protecting deposit.) In some embodiments, the directing member is suspended in the cell between the first sidewall portion and the second sidewall, and above the trough in order to direct the flow of the feed material into the trough. In some embodiments, the directing member is constructed of a material (at least one bath component) which is present in the bath chemistry at or near saturation, such that in the bath the directing member is maintained. In some embodiments, the directing member is configured to attach to a frame (e.g. of bath resistant material), where the frame is configured to adjust the directing member in the cell (i.e. move the directing member laterally (e.g. up or down relative to the cell height) and/or move the directing member longitudinally (e.g. left or right relative to the trough/cell bottom).

In some embodiments, the dimension of and/or the location of the directing member is selected to promote a certain configuration of the protecting deposit and/or a predetermined feed material flow pattern into the trough. In some embodiments, the directing member is attached to the anode assembly. In some embodiments, the directing member is attached to the sidewall of the cell. In some embodiments, the directing member is attached to the feed device (e.g. frame which holds the feed device into position. As non-limiting examples, the directing member comprises a plate, a rod, a block, an elongated member form, and combinations thereof. Some non-limiting examples of directing member materials include: anode materials; SiC; SiN; and/or components which are present in the bath at or near saturation such that the directing member is maintained in the bath.

As used herein, "longitudinally spaced" means the placement of one object from another object in relation to a length.

In some embodiments, laterally spaced (i.e. the second sidewall portion from the first sidewall portion—or the trough) means: at least 1", at least 1½", at least 2", at least 2½", at least 3", at least 3½", at least 4", at least 4½", at least 5", at least 5½", at least 6", at least 6½", at least 7", at least 7½", at least 8", at least 8½", at least 9", at least 9½", at least 10", at least 10½", at least 11", at least 11½", or at least 12".

In some embodiments, laterally spaced (i.e. the second sidewall portion from the first sidewall portion—or the trough) means: not greater than 1", not greater than 1/½", not greater than 2", not greater than 2½", not greater than 3", not greater than 3½", not greater than 4", not greater than 4½", not greater than 5", not greater than 5½", not greater than 6", not greater than 6½", not greater than 7", not greater than 7½", not greater than 8", not greater than 8½", not greater than 9", not greater than 9½", not greater than 10", not greater than 10½", not greater than 11", not greater than 11½", or not greater than 12".

As used herein, "laterally spaced" means the placement of one object from another object in relation to a width.

As used herein, "at least" means greater than or equal to.

As used herein, "not greater than" means less than or equal to.

As used herein, "trough" means a receptacle for retaining something. In one embodiment, the trough is defined by the first sidewall portion, the second sidewall portion, and the base (or bottom of the cell). In some embodiments, the trough retains the protecting deposit. In some embodiments the trough retains a feed material in the form of a protecting deposit, such that the trough is configured to prevent the protecting deposit from moving within the cell (i.e. into the metal pad and/or electrode portion of the cell).

In some embodiments, the trough comprises a material (at least one bath component) which is present in the bath chemistry at or near saturation, such that in the bath it is maintained.

In some embodiments, the trough further comprises a height (e.g. relative to the sidewall). As non-limiting embodiments, the trough height (as measured from the bottom of the cell to the bath/vapor interface comprises: at least ¼", at least ½", at least ¾", at least 1", at least 1¼", at least 1½", at least 1¾", at least 2", at least 2¼", at least 2½", at least 2¾", at least 3", 3¼", at least 3½", at least 3¾", at least 4", 4¼", at least 4½", at least 4¾", at least 5", 5¼", at least 5½", at least 5¾", or at least 6". In some embodiments, the trough height comprises: at least 6" at least 12" at least 18", at least 24", or at least 30".

As non-limiting embodiments, the trough height (as measured from the bottom of the cell to the bath/vapor interface comprises: not greater than ¼", not greater than ½", not greater than ¾", not greater than 1", not greater than 1¼", not greater than 1½", not greater than 1¾", not greater than 2", not greater than 2¼", not greater than 2½", not greater than 2¾", not greater than 3", 3¼", not greater than 3½", not greater than 3¾", not greater than 4", 4¼", not greater than 4½", not greater than 4¾", not greater than 5", 5¼", not greater than 5½", not greater than 5¾", or not greater than 6". In some embodiments, the trough height comprises: not greater than 6" not greater than 12" not greater than 18", not greater than 24", or not greater than 30".

As used herein, "protecting deposit" refers to an accumulation of a material that protects another object or material. As a non-limiting example, a "protecting deposit" refers to the feed material that is retained in the trough. In some embodiments, the protecting deposit is: a solid; a particulate form; a sludge; a slurry; and/or combinations thereof. In some embodiments, the protecting deposit is dissolved into the bath (e.g. by the corrosive nature of the bath) and/or is consumed through the electrolytic process. In some embodiments, the protecting deposit is retained in the trough, between the first sidewall portion and the second sidewall portion. In some embodiments, the protecting deposit is configured to push the metal pad (molten metal) away from the sidewall, thus protecting the sidewall from the bath-metal interface. In some embodiments, the protecting deposit is dissolved via the bath to provide a saturation at or near the cell wall which maintains the stable/non-reactive sidewall material (i.e. composed of a bath component at or near saturation). In some embodiments the protecting deposit comprises an angle of deposit (e.g. the protecting deposit forms a shape as it collects in the trough), sufficient to protect the sidewall and provide feed material to the bath for dissolution.

As used herein, "feed material" means a material that is a supply that assists the drive of further processes. As one non-limiting example, the feed material is a metal oxide which drives electrolytic production of rare earth and/or non-ferrous metals (e.g. metal products) in an electrolysis cell. In some embodiments, the feed material once dissolved or otherwise consumed, supplies the electrolytic bath with additional starting material from which the metal oxide is produced via reduction in the cell, forming a metal product. In some embodiments, the feed material has two non-limiting functions: (1) feeding the reactive conditions of the cell to produce metal product; and (2) forming a feed deposit in the channel between the wall at the inner sidewall to protect the inner sidewall from the corrosive bath environment. In some embodiments, the feed material comprises alumina in an aluminum electrolysis cell. Some non-limiting examples of feed material in aluminum smelting include: smelter grade alumina (SGA), alumina, tabular aluminum, and combinations thereof. In the smelting of other metals (non-aluminum), feed materials to drive those reactions are readily recognized in accordance with the present description. In some embodiments, the feed material is of sufficient size and density to travel from the bath-air interface, through the bath and into the trough to form a protecting deposit.

As used herein, "average particle size" refers to the mean size of a plurality of individual particles. In some embodiments, the feed material in particulate (solid) form having an average particle size. In one embodiment, the average particle size of the feed material is large enough so that it settles into the bottom of the cell (e.g. and is not suspended in the bath or otherwise "float" in the bath). In one embodiment, the average particle size is small enough so that there is adequate surface area for surface reactions/dissolution to occur (e.g. consumption rate).

As used herein, "feed rate" means a certain quantity (or amount) of feed in relation to a unit of time. As one non-limiting example, feed rate is the rate of adding the feed material to the cell. In some embodiments, the size and/or position of the protecting deposit is a function of the feed rate. In some embodiment, the feed rate is fixed. In another embodiment, the feed rate is adjustable. In some embodiments, the feed is continuous. In some embodiments, the feed is discontinuous.

As used herein, "consumption rate" means a certain quantity (or amount) of use of a material in relation to a unit of time. In one embodiment, consumption rate is the rate that the feed material is consumed by the electrolysis cell (e.g. by the bath, and/or consumed to form metal product).

In some embodiments, the feed rate is higher than the consumption rate. In some embodiment, the feed rate is configured to provide a protecting deposit above the bath-air interface.

As used herein, "feeder" (sometimes called a feed device) refers to a device that inputs material (e.g. feed) into something. In one embodiment, the feed device is a device that feeds the feed material into the electrolysis cell. In some embodiments, the feed device is automatic, manual, or a combination thereof. As non-limiting examples, the feed device is a curtain feeder or a choke feeder. As used herein, "curtain feeder" refers to a feed device that moves along the sidewall (e.g. with a track) to distribute feed material. In one embodiment, the curtain feeder is movably attached so that it moves along at least one sidewall of the electrolysis cell.

As used herein, "choke feeder" refers to a feed device that is stationary on a sidewall to distribute feed material into the cell. In some embodiments, the feed device is attached to the sidewall by an attachment apparatus. Non-limiting examples include braces, and the like.

In some embodiments, the feed device is automatic. As used herein, "automatic" refers to the capability to operate independently (e.g. as with machine or computer control). In some embodiments, the feed device is manual. As used herein, "manual" means operated by human effort.

As used herein, "feed block" refers to feed material in solid form (e.g. cast, sintered, hot pressed, or combinations thereof). In some embodiments, the base of the trough comprises a feed block. As one non-limiting example, the feed block is made of alumina.

As used here, "non-reactive sidewall" refers to a sidewall which is constructed or composed of (e.g. coated with) a material which is stable (e.g. non-reactive, inert, dimensionally stable, and/or maintained) in the molten electrolyte bath at cell operating temperatures (e.g. above 750° C. to not greater than 960° C.). In some embodiments, the non-reactive sidewall material is maintained in the bath due to the bath chemistry. In some embodiments, the non-reactive sidewall material is stable in the electrolyte bath since the bath comprises the non-reactive sidewall material as a bath component in a concentration at or near its saturation limit in the bath. In some embodiments, the non-reactive sidewall material comprises at least one component that is present in the bath chemistry. In some embodiments, the bath chemistry is maintained by feeding a feed material into the bath, thus keeping the bath chemistry at or near saturation for the non-reactive sidewall material, thus maintaining the sidewall material in the bath.

Some non-limiting examples of non-reactive sidewall materials include: Al; Li; Na; K; Rb; Cs; Be; Mg; Ca; Sr; Ba; Sc; Y; La; or Ce-containing materials, and combinations thereof. In some embodiments, the non-reactive material is an oxide of the aforementioned examples. In some embodiments, the non-reactive material is a halide salt and/or fluoride of the aforementioned examples. In some embodiments, the non-reactive material is an oxofluoride of the aforementioned examples. In some embodiments, the non-reactive material is pure metal form of the aforementioned examples. In some embodiments, the non-reactive sidewall material is selected to be a material (e.g. Ca, Mg) that has a higher electrochemical potential than (e.g. cations of these materials are electrochemically more noble than) the metal product being produced (e.g. Al), the reaction of the non-reactive sidewall material is less desirable (electrochemically) than the reduction reaction of Alumina to Aluminum. In some embodiments, the non-reactive sidewall is made from castable materials. In some embodiments, the non-reactive sidewall is made of sintered materials.

Example

Bench Scale Study: Sidefeeding

Bench scale tests were completed to evaluate the corrosion-erosion of an aluminum electrolysis cell. The corrosion-erosion tests showed that alumina, and chromia-alumina materials were preferentially attacked at the bath-metal interface. Also, it was determined that the corrosion-erosion rate at the bath-metal interface is accelerated dramatically when alumina saturation concentration is low (e.g. below about 95 wt. %). With a physical barrier of feeding materials, i.e. to feed increase the alumina saturation concentration, the barrier (e.g. of alumina particles) operated to keep alumina saturated at bath-metal interface to protect the sidewall from being dissolved by the bath. Thus, the sidewall at the bath-metal interface is protected from corrosive-erosive attack and the aluminum saturation concentration was kept at about 98 wt. %. After performing electrolysis for a period of time, the sidewall was inspected and remained intact.

Example

Pilot Scale Test: Automated Sidefeeding with Rotary Feeder

A single hall cell was operated continuously for about 700 hr with a trough along the sidewall around the perimeter of the cell (e.g. via a rotary feeder). The feeder included a hopper, and rotated along the sidewall to feed the entire sidewall (along one sidewall). A feed material of tabular alumina was fed into the cell at a location to be retained in the trough by an automatic feeder device. After electrolysis was complete, the sidewall was inspected and found intact (i.e. the sidewall was protected by the side feeding).

Example

Full Pot Test Sidefeeding (Manual)

A commercial scale test on sidewall feeding was operated continuously for a period of time (e.g. at least one month) with a trough along the sidewall via manual feeding. A feed material of tabular alumina was fed into the cell manually at a location adjacent to the sidewall such that the alumina was retained in a trough in the cell, located adjacent to the sidewall. Measurements of the sidewall profile showed minimum corrosion-erosion of the sidewall above the trough, and trough profile measurements indicated that the trough maintained its integrity throughout the operation of the cell. Thus, the manually fed alumina protected the metal-bath interface of the sidewall of the cell from corrosion-erosion. An autopsy of the cell was performed to conclusively illustrate the foregoing.

While various embodiments of the present invention have been described in detail, it is apparent that modifications and adaptations of those embodiments will occur to those skilled in the art. However, it is to be expressly understood that such modifications and adaptations are within the spirit and scope of the present invention.

REFERENCE NUMBERS

Cell 10
Anode 12
Cathode 14
Electrolyte bath 16
Metal pad 18
Cell body 20
Electrical bus work 22
Anode assembly 24
Current collector bar 40
Active sidewall 30
Sidewall 38 (e.g. includes active sidewall and thermal insulation package)
Bottom 32
Outer shell 34
Feed block 60
Bath-air interface 26
Metal—bath interface 28

What is claimed is:

1. An electrolysis cell, comprising:
an anode;
a cathode in spaced relation from the anode;
a molten electrolyte bath in liquid communication with the anode and the cathode, wherein the molten electrolyte bath comprises a bath chemistry including at least one bath component;
a cell body having: a bottom and at least one sidewall surrounding the bottom, wherein the cell body is configured to retain the molten electrolyte bath, wherein the sidewall consists essentially of the at least one bath component, the sidewall further comprising:
a first sidewall portion, configured to fit onto a thermal insulation package of the sidewall and retain the electrolyte; and
a second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough;

wherein the trough is configured to receive a protecting deposit and retain the protecting deposit separately from the cell bottom;

wherein the protecting deposit is configured to dissolve from the trough into the molten electrolyte bath such that the molten electrolyte bath comprises a level of the at least one bath component which is sufficient to maintain the first sidewall portion and second sidewall portion in the molten electrolyte bath.

2. The electrolysis cell of claim 1, wherein the bath component comprises an average bath content of: within 1% of saturation.

3. The electrolysis cell of claim 1, wherein the saturation of the bath component is: at least 95% of saturation.

4. The electrolysis cell of claim 1, wherein the bath component comprises a bath content saturation percentage measured at a location adjacent to the sidewall.

5. The electrolysis cell of claim 4, wherein the location adjacent to the sidewall further comprises: not greater than 6" from the sidewall.

6. An electrolysis cell, comprising:

an anode;

a cathode in spaced relation from the anode;

a molten electrolyte bath in liquid communication with the anode and the cathode, wherein the molten electrolyte bath comprises a bath chemistry including at least one bath component;

a cell body having: a bottom and at least one sidewall surrounding the bottom, wherein the cell body is configured to retain the molten electrolyte bath, wherein the sidewall consists essentially of the at least one bath component, the sidewall further comprising:

a first sidewall portion, configured to fit onto a thermal insulation package of the sidewall and retain the electrolyte; and a second sidewall portion configured to extend up from the bottom of the cell body, wherein the second sidewall portion is longitudinally spaced from the first sidewall portion, such that the first sidewall portion, the second sidewall portion, and a base between the first portion and the second portion define a trough; wherein the trough is configured to receive a protecting deposit and retain the protecting deposit separate from the cell bottom;

wherein the protecting deposit is configured to dissolve from the trough into the molten electrolyte bath such that the molten electrolyte bath comprises a level of the at least one bath component which is sufficient to maintain the first sidewall portion and second sidewall portion in the molten electrolyte bath; and a directing member, wherein the directing member is positioned between the first sidewall portion and the second sidewall portion, further wherein the directing member is laterally spaced above the trough, such that the directing member is configured to direct the protecting deposit into the trough.

7. The electrolysis cell of claim 6, wherein the bath component comprises an average bath content of: within 1% of saturation.

8. The electrolysis cell of claim 6, wherein the saturation of the bath component is: at least 95% of saturation.

9. The electrolysis cell of claim 6, wherein the bath component comprises a bath content saturation percentage measured at a location adjacent to the sidewall.

10. The electrolysis cell of claim 9, wherein the location adjacent to the sidewall further comprises: not greater than 6" from the sidewall.

11. An assembly, comprising:

an electrolysis sidewall having a first portion and a second portion, wherein the second portion is configured to align with the first sidewall portion with respect to a thermal insulation package, further wherein the second sidewall portion is configured to extend from the sidewall in a stepped configuration, wherein the second sidewall portion comprises an upper surface and a side surface which define the stepped portion.

12. The assembly of claim 11, wherein the upper surface is configured to provide a planar surface.

13. The assembly of claim 11, wherein the upper surface is configured to provide a sloped surface, wherein the sloped surface comprises a slope towards the first sidewall portion to provide, via cooperation between the first sidewall portion and the upper surface of the second sidewall portion, a recessed area.

14. The assembly of claim 13, wherein the recessed area is configured to retain a protecting deposit therein.

15. The assembly of claim 14, wherein the protecting deposit comprises the at least one bath component.

16. The assembly of claim 11, wherein a base comprises an at least one bath component.

17. The assembly of claim 16, wherein the bath component comprises an average bath content of: within 1% of saturation.

18. The assembly of claim 16, wherein the saturation of the bath component is: at least 95% of saturation.

19. The assembly of claim 16, wherein the bath component comprises a bath content saturation percentage measured at a location adjacent to the sidewall.

20. The assembly of claim 19, wherein the location adjacent to the sidewall further comprises: not greater than 6" from the sidewall.

21. The assembly of claim 11, wherein a protecting deposit extends from a trough and up to at least an upper surface of an electrolyte bath.

22. The assembly of claim 11, comprising:

a directing member, wherein the directing member is positioned between the first sidewall portion and the second sidewall portion, further wherein the directing member is positioned above a base of a trough, further wherein the directing member is configured to direct a protecting deposit into the trough.

23. The assembly of claim 22, wherein the directing member is constructed of a material which is present in a bath chemistry, such that via the bath chemistry, the directing member is maintained in the molten salt electrolyte.

24. The assembly of claim 11, wherein a base of a trough is defined by a feed block, wherein the feed block is constructed of a material selected from components in a bath chemistry, wherein via the bath chemistry, the feed block is maintained in the molten salt bath.

25. The assembly of claim 11, further comprising a feeder configured to provide a protecting deposit in a trough.

26. A method, comprising:

passing current between an anode and a cathode through a molten electrolyte bath of an electrolytic cell, feeding a feed material into the electrolytic cell to supply the molten electrolyte bath with at least one bath component, wherein feeding is at a rate sufficient to maintain a bath content of the at least one bath component to within 95% of saturation and not greater than 100% of saturation; and via the feeding step, maintaining a sidewall of the electrolytic cell constructed of a material including the at least one bath component.

27. The method of claim 26, comprising:

concomitant to the first step, maintaining the bath at a temperature not exceeding 960° C., such that the sidewalls of the cells are substantially free of a frozen ledge.

28. The method of claim 26, comprising: consuming a protecting deposit to supply metal ions to the electrolyte bath.

29. The method of claim 26, comprising: producing a metal product from the at least one bath component.

30. The method of claim 26, wherein the bath component comprises an average bath content of: within 1% of saturation.

31. The method of claim 26, wherein the bath component comprises a bath content saturation percentage measured at a location adjacent to the sidewall.

32. The method of claim 31, wherein the location adjacent to the sidewall further comprises: not greater than 6" from the sidewall.

* * * * *